US006119491A

United States Patent [19]

Pinelli

[11] Patent Number: 6,119,491

[45] Date of Patent: Sep. 19, 2000

[54] GIRDLE FOR TIGHTS, SUBSTANTIALLY THE REGION THAT CONSTITUTES THE PANTY, FORMED BY A TUCK-STITCH MESH, SO AS TO GIVE THE MESH A HIGH RELIEF EFFECT WITH ALTERNATING UNDULATIONS

[76] Inventor: Enzo Pinelli, Via Germania, 13, 46042 Castel Goffredo (Prov. di Mantova), Italy

[21] Appl. No.: 09/024,266

[22] Filed: Feb. 17, 1998

[30] Foreign Application Priority Data

Oct. 14, 1997 [IT] Italy ..... MI97A2320

[51] Int. Cl.[7] ..... D04B 7/00

[52] U.S. Cl. ..... 66/177; 66/178 R; 66/178 A; 66/180; 66/182; 66/188; 66/195; 66/196

[58] Field of Search ..... 66/178 R, 180, 66/178 A, 182, 188, 195, 196, 177

[56] References Cited

U.S. PATENT DOCUMENTS

| | | | |
|---|---|---|---|
| 3,834,191 | 9/1974 | Fregolle | 66/147 |
| 3,933,013 | 1/1976 | Cassidy, Sr. | 66/175 |
| 4,236,257 | 12/1980 | Williams et al. | 2/406 |
| 4,702,091 | 10/1987 | Good et al. | 66/171 |
| 5,185,000 | 2/1993 | Brandt et al. | 602/63 |
| 5,280,652 | 1/1994 | Davis et al. | 2/409 |
| 5,373,713 | 12/1994 | Miller | 66/196 |
| 5,419,161 | 5/1995 | Bodenschatz et al. | 66/172 E |
| 5,785,732 | 8/1998 | Perron et al. | 66/177 |

FOREIGN PATENT DOCUMENTS

| | | |
|---|---|---|
| 0498062 | 8/1992 | European Pat. Off. . |
| 2588890 | 4/1987 | France . |

OTHER PUBLICATIONS

Patent Abstracts of Japan, vol. 096, No. 004, Apr. 30, 1996 & JP 07 316959 A (Kanebo Ltd), Dec. 5, 1995 *Abstract*.

*Primary Examiner*—John J. Calvert
*Assistant Examiner*—Robert H. Muromoto, Jr.
*Attorney, Agent, or Firm*—Guido Modiano; Albert Josif; Daniel O'Byrne

[57] ABSTRACT

A girdle for tights or pantyhose, in which the regions that constitute the panty and the initial portions of the stretch hose are constituted by a tuck-stitch mesh, formed starting from a plain background mesh so as to obtain, by combining and knitting in three dimensions particular conventional threads and elastic threads which are conveniently woven together, a mesh having alternating undulations which are considerably in relief with respect to the plain mesh, such as to generate an adequate compression and thus a massaging and tonic action in the regions of the body contained in the girdle.

8 Claims, 2 Drawing Sheets

4
4a
12
11
9a
11a
12
8a
9
13
13
3
3a
8
A
13a
2
3
14
6
10
13a
6a
2a
3
14a
A1

12
7a
13a
13
7
11
11a
10
1
2
2a
14
14a
11
11b
11c

GIRDLE FOR TIGHTS, SUBSTANTIALLY THE REGION THAT CONSTITUTES THE PANTY, FORMED BY A TUCK-STITCH MESH, SO AS TO GIVE THE MESH A HIGH RELIEF EFFECT WITH ALTERNATING UNDULATIONS

BACKGROUND OF THE INVENTION

The present invention relates to a girdle for tights, particularly to the region that constitutes the panty and part of the tubular regions related to the thighs, formed by a tuck-stitch mesh which is produced so as to give said mesh a high relief effect according to alternating mesh undulations on the sides of said mesh, said alternating undulations being able to produce a massaging and relaxing effect on the parts of the body that are affected by the girdle.

Conventional tights, generally known as pantyhose, are constituted by a stretch mesh whose characteristics and type of thread are uniform as regards both the two long stockings and the upper part that joins the top of the two stockings to a tubular girdle which substantially constitutes the actual panty.

It is also well-known that the great success achieved by current tights of various sizes is due to the fact that the type of weft and the elasticity of the threads used to manufacture them produce an undisputed comfort, especially for the legs of the wearer. The constant and slight pressure that the stretch mesh applies to the parts surrounded by the stockings produces an effective support action. Moreover, current tights are usually produced with threads of different sizes, so that they are also suitable to protect from the cold; they are also produced with fabrics known as plain mesh or composite mesh and also with ribbed mesh or "pattern" mesh on automatic machines.

It is evident that the various currently commercially available types of stretch pantyhose of any kind perform only support and protection for both the actual stockings and the panty connected to the top of the stockings.

SUMMARY OF THE INVENTION

Accordingly, the aim of the present invention is to provide tights or pantyhose in which at least the girdle constituted by the panty and preferably also a part of the tubular regions that cover ample regions of the thighs is conceived and structured so as to produce a massaging, tonic and relaxing effect in the parts affected by the girdle, with the additional advantage of also adequately compressing the affected parts, providing them with considerable comfort during the movements of the body of the pantyhose wearer.

Within the scope of this aim, an object of the present invention is to provide a girdle or panty for tights with a tuck-stitch mesh provided with regions which are highly in relief or constituted by alternating undulations on the plain base mesh and regions which are less in relief, with oblique undulations or the like, in addition to regions with plain mesh.

This aim, this object and others which will become apparent hereinafter from the description that follows are achieved by a girdle for tubular stretch tights (pantyhose), in which, according to the present invention, the regions that constitute the panty and the initial portions of the stretch hose are constituted by a tuck-stitch mesh, formed starting from a plain background mesh so as to obtain, by combining and knitting in three dimensions particular conventional threads and elastic threads which are woven together, a mesh having alternating undulations which are considerably in relief with respect to the plain mesh, such as to generate an adequate compression and thus a massaging and tonic action in the regions of the body contained in the girdle.

More particularly, the girdle and the corresponding hose portions that cover part of the thighs are formed starting from two identical tubular bodies which are cut longitudinally up to the so-called crotch region and then assembled by sewing.

The assembled girdle also has a tuck-stitch mesh structure with highly raised undulations at the buttocks, hips and tubular portions that adhere to the thighs, while at the front, at the abdomen, it has a tuck-stitch mesh which is less raised and has undulations which are oblique or the like only on the outer side of the fabric.

Moreover, said tuck-stitch mesh girdle is completed by an upper tubular border or elastic waistband made of conventional plain stretch mesh or the like.

Finally, the girdle or panty and the corresponding tubular parts that affect the thighs are provided by means of a combined use of threads of various dimensions and of elastic threads.

BRIEF DESCRIPTION OF THE DRAWINGS

Further characteristics and advantages of the present invention will become apparent from the following detailed description, given with reference to the accompanying drawings, which are provided merely by way of non-limitative example and wherein.

DESCRIPTION OF THE PREFERRED EMBODIMENTS

With reference to the above figures and as specified above, the present invention relates to the particular tuck-stitch mesh structure only of the girdle and of the initial portions of the two conventional stockings of a stretch pantyhose.

The mesh structure is achieved by using conventional automatic circular hosiery knitting machines whereby, starting from a smooth-background mesh pattern, i.e., in which the needles, which are generally four, are kept simultaneously fed with thread, in order to obtain a highly raised mesh it is necessary to cause the intervention, for every two needles, of another needle which holds the mesh being formed for a certain number of turns, usually four; during said turns, the needle remains motionless and is fed and shifted with respect to the other needles, until, again by means of suitably preset patterns, the needle with held thread receives the command to perform the so-called "drop". In this manner, a mesh is obtained which has the intended effect, i.e., a tuck-stitch mesh in high relief, with undulations which are alternated or formed only on a single side of the mesh. The elasticity of the mesh is increased by the insertion, during the formation of the mesh, of conventional stretch threads 5 (FIG. 1).

Figure 1:
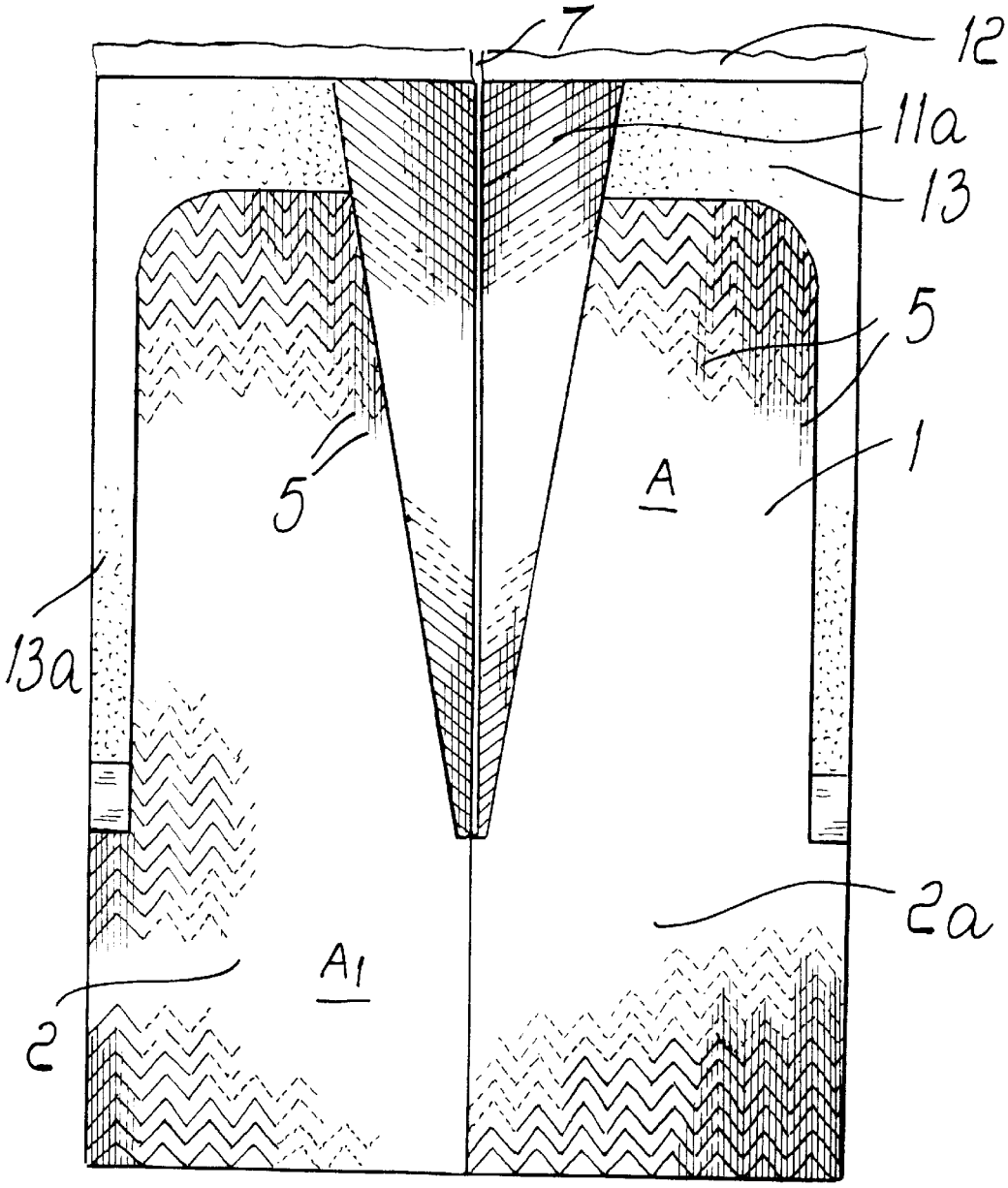
FIG. 1 is a flattened view of a complete girdle for pantyhose, executed according to the present invention.
Figure 1A:
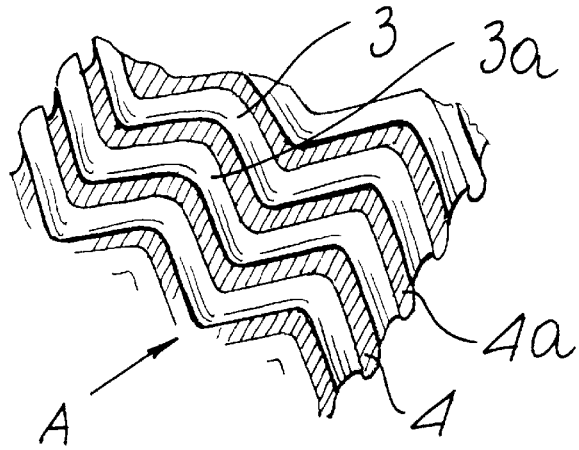
FIG. 1*a* is a sectional perspective view of a portion of tuck-stitch mesh with large alternating undulations which constitute the body of the girdle of FIG. 1.
Figures 2, 3, 3A:
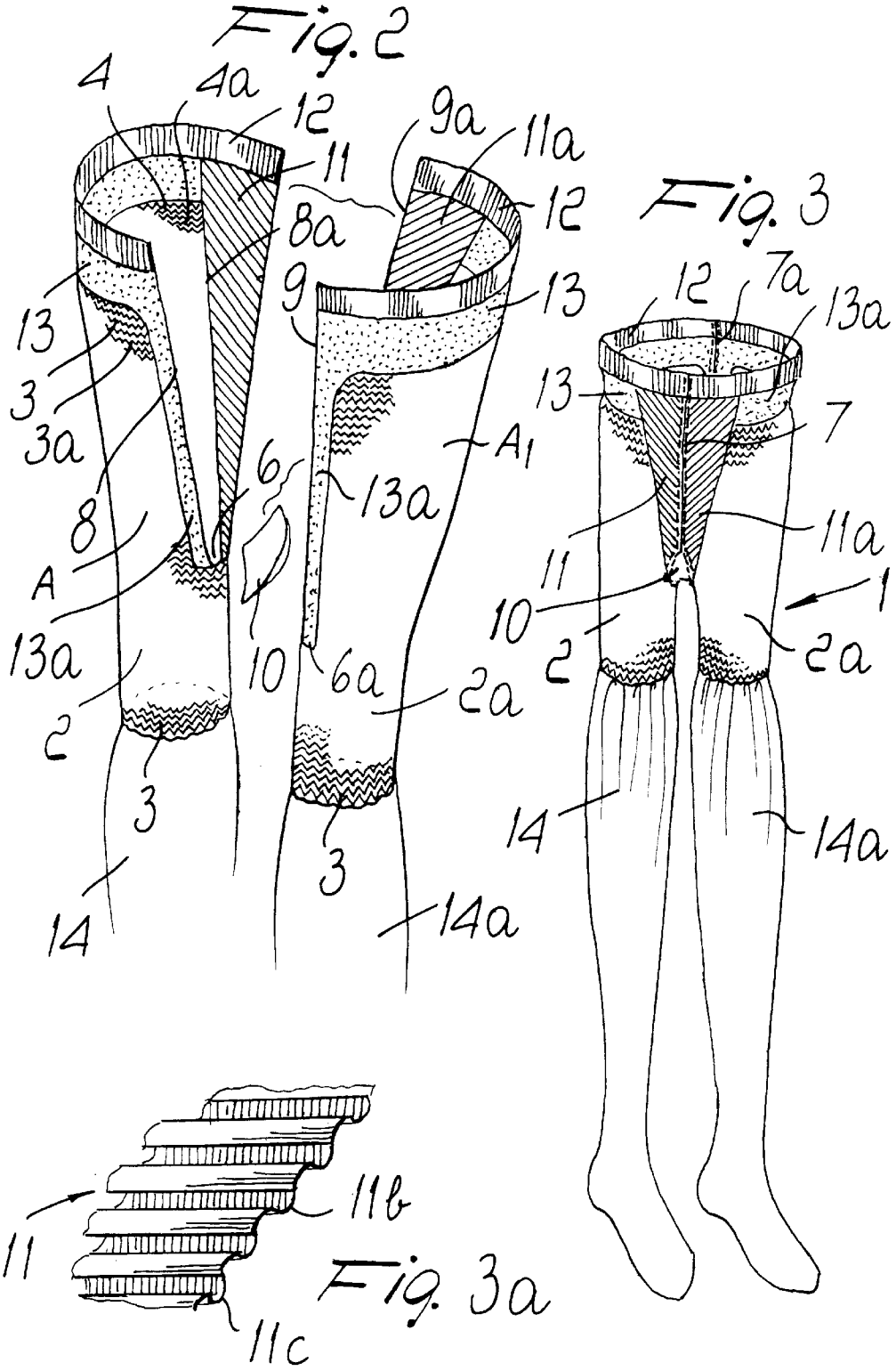
FIG. 2 is a view of the girdle of FIG. 1, divided into two tubular elements which are open and ready for assembly.
FIG. 3 is a perspective view of a finished pantyhose executed according to the present invention.
FIG. 3*a* is a perspective sectional view of a tuck-stitch mesh portion which constitutes only the front part of the girdle.

FIG. 1*a* illustrates a portion of tuck-stitch relief mesh, generally designated by the reference letter A, which is used to form substantially all of the tubular girdle 1 and the initial part 2–2*a* of conventional long stockings (FIGS. 1 and 2).

FIG. 1*a* shows the raised undulations 3–3*a* etcetera, which protrude from one side of the mesh A–A1, and the alternating and opposite undulations 4–4*a*, which protrude from the opposite side of the mesh A–A1.

The tubular body that constitutes the girdle A–A1 and the corresponding portions 2–2*a* is obtained by means of a separate production of two identical tubular bodies A–A1 which are cut longitudinally up to the regions 6 and 6*a*, respectively (FIG. 2), which are meant to be mutually joined by the so-called crotch 10. The two bodies A–A1 and the lower parts 2–2*a* are assembled by conventional sewings 7–7*a* (FIG. 3) of the opposite edges 8–8*a* and 9–9*a* of the two open tubular elements and by means of the subsequent sewing of the fabric or plain-mesh crotch 10 in the lower joining region, as shown in FIG. 3.

Also according to the invention, in the triangular region 11–11*a* of the girdle that relates to the front part which is in contact with the abdomen and in the narrower regions 13–13*a* which are meant to be sewn to each other and to the conventional waistband 12, the raised tuck-stitch mesh is provided as shown in FIG. 3*a*; in this case, the raised undulations 11*b*–11*c* etcetera are provided only on the side of the mesh that is meant to remain on the outside of the pantyhose and with an oblique orientation with respect to the undulations A; this is done to avoid excessive compression in the abdominal region.

Finally, the tubular body of the girdle A–A1 has an annular border 12 made of a stretch mesh which is thicker (or heavier) than the mesh of the regions 13–13*a*.

The resulting girdle A–A1 is then sewn in a known manner to the upper border of the socks 14–14*a*.

In practice, it has been observed that a girdle executed according to the present invention, i.e., with a weaving of particular threads, produces a tuck-stitch mesh which can give the fabric a considerable relief with alternating undulations, with the advantage of allowing, while wearing the pantyhose and during movements of the pelvis, to produce rubbing of the raised undulated regions against the skin, thus generating localized micromassages and accordingly providing beneficial, tonic and relaxing effects.

The invention as described is of course susceptible of structurally and functionally equivalent modifications and variations in its practical execution without abandoning the scope of the protection of said invention.

What is claimed is:

1. A girdle for tubular stretch tights or pantyhose, comprising:

a panty region; and a stretch hose, wherein the regions that constitute the panty and the initial portions of the stretch hose are constituted by a tuck-stitch mesh, said mesh having alternating undulations which are in relief with respect to the plain mesh, such as to generate a compression and thus a massaging and tonic action in the regions of the body contained in the girdle; said alternating undulations being formed by combining and knitting together threads and elastic threads, said undulations being obtained by holding the mesh being formed for a preset number of turns.

2. The girdle for tights according to claim 1, wherein said girdle and said corresponding hose portions that cover part of the thighs are formed starting from two identical tubular bodies which are cut longitudinally up to the so-called crotch region and are then assembled by sewing.

3. The girdle according to claim 1, wherein said tuck-stitch mesh has protruding undulations at the buttocks, at the hips and at the tubular portions that adhere to the thighs, while in the front region, at least at the abdomen, it has a tuck-stitch mesh which is less raised and has undulations only on the outer side of the fabric which are arranged oblique with respect to the undulations present in the other portions of the girdle.

4. The girdle according to claim 1, wherein above the tubular body that constitutes the girdle there is provided a waistband or annular elastic border made of plain-stitch mesh.

5. The girdle according to claim 1, wherein said preset number of turns is determined so as to create said undulations which protrude from said plain mesh in order to provide said compression and massaging action.

6. A method for manufacturing a girdle for tubular stretch tights or pantyhose by means of circular hosiery knitting machine, comprising the steps of:

starting from a smooth-background mesh in which needles of said machine are kept simultaneously fed with thread, using every two needles an additional needle to hold the mesh being formed for a preset number of turns; and dropping the thread held by said additional needle.

7. The method according to claim 6, wherein said preset number of turns is greater than four.

8. The method of claim 6, wherein said thread is knitted together with an elastic thread.

* * * * *

UNITED STATES PATENT AND TRADEMARK OFFICE

CERTIFICATE OF CORRECTION

PATENT NO. : 6,119,491
DATED : September 19, 2000
INVENTOR(S) : Enzo Pinelli

It is certified that error appears in the above-identified patent and that said Letters Patent is hereby corrected as shown below:

Column 4,
Lines 14-15, "for a preset number of" should read -- by at least two --.
Lines 34-35, "preset number of turns is" should read -- at least two turns --.
Lines 44-45, "for a preset number of" should read -- by at least two --.

Signed and Sealed this

Twenty-seventh Day of May, 2003

JAMES E. ROGAN
*Director of the United States Patent and Trademark Office*